US006575794B1

(12) United States Patent
Nakamura

(10) Patent No.: US 6,575,794 B1
(45) **Date of Patent: *Jun. 10, 2003**

(54) SPLIT CONNECTOR WITH A COVER

(75) Inventor: Hideto Nakamura, Yokkaichi (JP)

(73) Assignee: Sumitomo Wiring Systems, Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/559,877

(22) Filed: Apr. 27, 2000

(30) Foreign Application Priority Data

Apr. 28, 1999 (JP) ..... 11-121646

(51) Int. Cl.[7] ..... H01R 13/502

(52) U.S. Cl. ..... 439/701; 439/902; 439/352; 439/357; 439/553

(58) Field of Search ..... 439/355, 357, 439/358, 468, 599, 686, 701, 902, 553, 540.1, 556, 559, 552, 157, 752

(56) References Cited

U.S. PATENT DOCUMENTS 5,238,426 A * 8/1993 Arnett ..... 439/557
5,263,871 A * 11/1993 Sano ..... 439/157
5,328,388 A * 7/1994 Fust et al. ..... 439/540 X
5,344,347 A * 9/1994 Inoue et al. ..... 439/701
5,378,173 A * 1/1995 Hashizawa ..... 439/701
5,389,015 A * 2/1995 Sasai et al. ..... 439/752
5,725,397 A * 3/1998 Fukamachi et al. ..... 439/701
5,769,660 A * 6/1998 Sakurai et al. ..... 439/552 X
5,855,486 A 1/1999 Fukamachi et al. ..... 439/157
5,931,688 A * 8/1999 Hasz et al. ..... 439/247
6,065,983 A * 5/2000 Norizuki et al. ..... 439/157
6,155,884 A * 12/2000 Sugiyama ..... 439/701

* cited by examiner

*Primary Examiner*—Lynn D. Feild
*Assistant Examiner*—Son V. Nguyen
(74) *Attorney, Agent, or Firm*—Banner & Witcoff, Ltd.

(57) ABSTRACT

A split connector is provided with a cover wherein transportation and assembly can be performed simply. Two housing chambers are provided within a frame, and sub-housings are housed respectively therein, these being covered from their posterior faces by a cover attached thereto. A base face and an upper face of a posterior end portion of the first sub-housing are each provided with two locking protrusions, and a base face and an upper face of a posterior end portion of the second sub-housing are each provided with one locking protrusion. Locking members protrude from side plates of a long and narrow portion on the left side of the cover. Locking holes are formed in the tips thereof, the locking protrusions fitting therein. Locking holes are formed in side plates of a protruding portion on the right side of the cover, these locking holes fitting with the locking protrusion. In the case where the frame has already been attached in advance to a panel or the like, the two sub-housings and the cover are pre-assembled and are then transported in that state to the site where they will be attached to the frame.

10 Claims, 6 Drawing Sheets

SPLIT CONNECTOR WITH A COVER

TECHNICAL FIELD

The present invention relates to a split electrical connector with a cover provided with a cover.

BACKGROUND TO THE INVENTION

A type of split electrical connector provided with a cover is described in JP-8-78097. This split connector has a configuration whereby a plurality of housing chambers are provided within a frame. A sub-connector housing is inserted from a posterior face into each housing chamber and is retained therein, and a cover is provided over a posterior face of each sub-connector housing, this cover being locked to a posterior edge of the frame. Electric wires which extend from the posterior face of each sub-connector housing are gathered together and housed within the cover, as a consequence they can be directed in a prescribed direction.

That is, in the conventional split connector, the cover is fixed to the frame.

However, depending on the installation, there are cases involving this type of split connector where the frame is first fixed to a panel, etc. of a motor vehicle, and then the sub-connector housings and covers are attached from the posterior. In such a case, when these conventional split connectors are assembled, each sub-connector housing and cover must be transported in a separate state to the site where they are attached to the frame, the sub-connector housings are then attached to the frame, and then the covers are attached. There is the problem that this transportation is troublesome and the attachment operation is time-consuming.

The present invention has taken the above problem into consideration, and aims to present a split connector provided with a cover in which transportation and attachment are simplified.

SUMMARY OF THE INVENTION

According to the invention there is provided an electrical split connector comprising a frame adapted to be fixed in a panel, and defining a plurality of chambers, a plurality of sub-connectors having wires protruding therefrom and for insertion one each into said chambers, and a cover adapted to enclose and guide wires of said sub-connectors in a predetermined direction, characterised in that said sub-connectors and cover are provided with co-operating latch members, thereby to form a sub-assembly for subsequent insertion into said frame.

In a preferred embodiment said latch members comprise protrusions of said sub-connectors and cooperating openings of said cover. The openings may be provided on resilient projections of the cover, and the projections preferably extend in the fitting direction of the cover.

The projections may laterally engage guide surfaces of one or more of said sub-connectors.

The invention also comprises a method of inserting a plurality of sub-connectors into panel and comprising the steps of:

fixing a frame in an aperture of a panel;

latching a plurality of sub-connectors to a cover to form a sub-assembly, the cover enclosing and guiding wires protruding from the respective sub-connectors; and inserting said sub-assembly into said frame.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
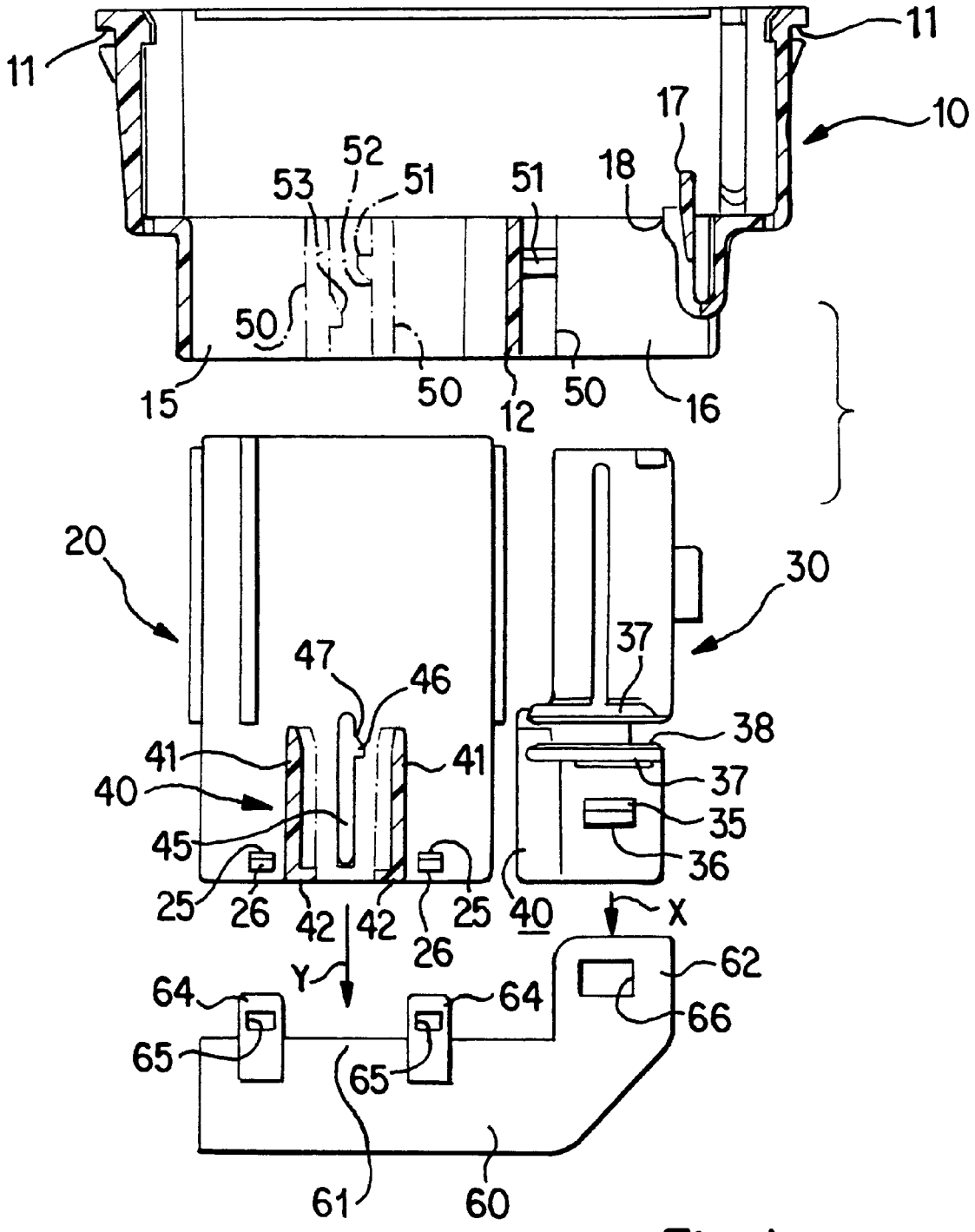
FIG. 1 is a disassembled base face view of a first embodiment of the present invention.

As shown in FIG. 1, a split connector of the present embodiment has two housing chambers 15 and 16 provided within a frame 10, these housing chambers 15 and 16 respectively housing two female sub-connector housings 20 and 30 (hereafter referred to as sub-housings). A cover 60 covers posterior faces of the sub-housings 20 and 30, and male connector housings (not shown) fit individually with anterior faces of each of the sub-housings 20 and 30.

FIG. 1 is an exploded view of the components.

The frame 10 is cylindrical and is stepped so that an anterior face (at the top in FIG. 1) is larger. The frame 10 is inserted from an anterior direction into an attachment hole 71 of a panel (see FIG. 7) attached to a car body or the like. A stopping groove 11 formed on an outer circumference of an anterior edge of the frame 10 fits with a hole edge of the attachment hole 71, thereby attaching the frame 10.

Figure 2:
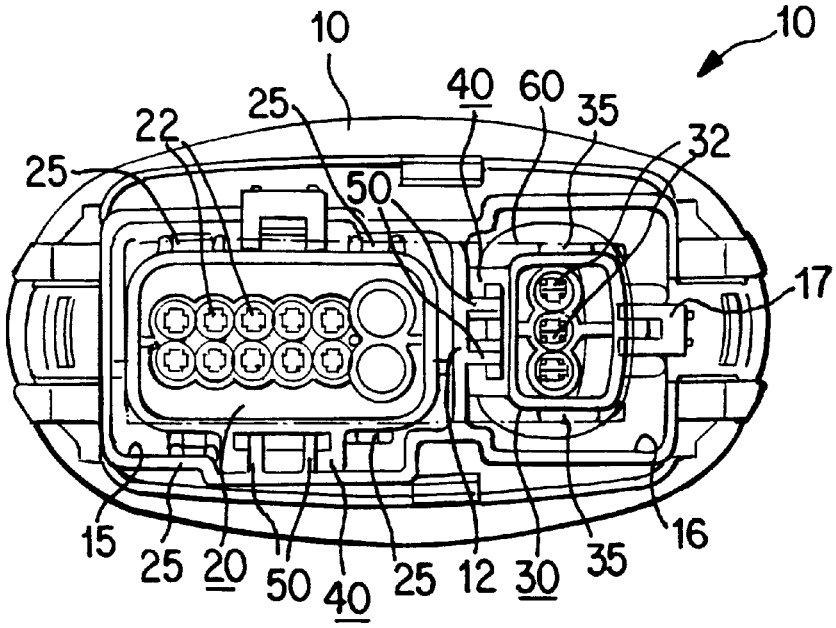
FIG. 2 is a rear face view of sub-housings in a housed state within a frame.
Figure 3:
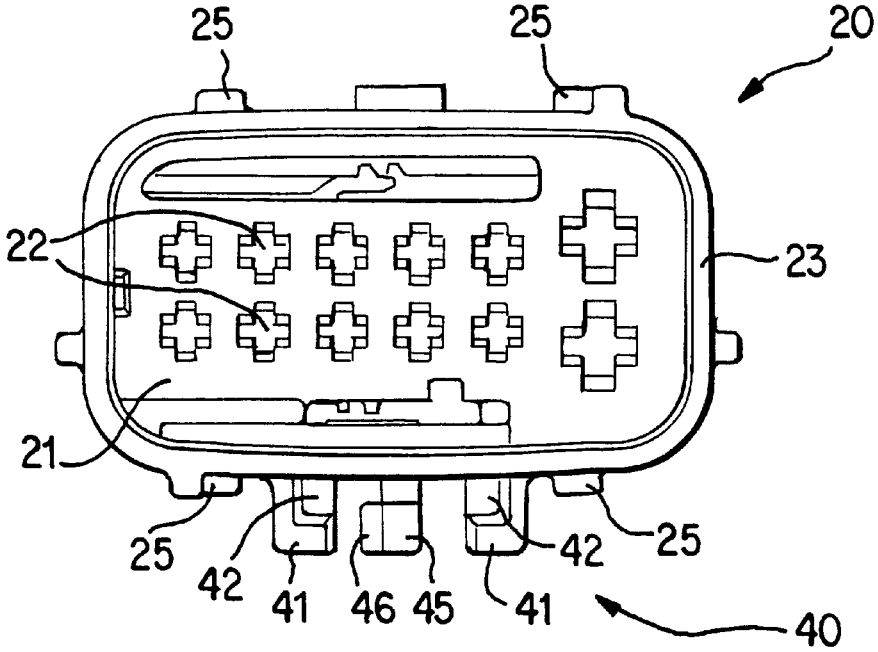
FIG. 3 is a front view of a first sub-housing.

As shown in FIG. 2, a partitioning wall 12 is formed at a posterior portion within the frame 10, this partitioning wall 12 dividing the frame 10 into left and right housing chambers. These form the first housing chamber 15 and the second housing chamber 16 respectively. The first sub-housing 20 and the second sub-housing 30 are respectively housed within these left and right housing chambers 15 and 16. As shown in FIG. 3, the first sub-housing 20 has an approximately rectangular cross-sectional shape, the corners thereof being rounded. A plurality of cavities 22 (twelve are shown) formed in an aligned manner within a terminal housing member 21 form two rows, an upper and a lower row. A hood member 23 is formed on an outer circumference of an anterior face of the terminal housing member 21. Female terminal fittings (not shown) are inserted from a posterior direction into the cavities 22 and are housed therein.

Figure 4:
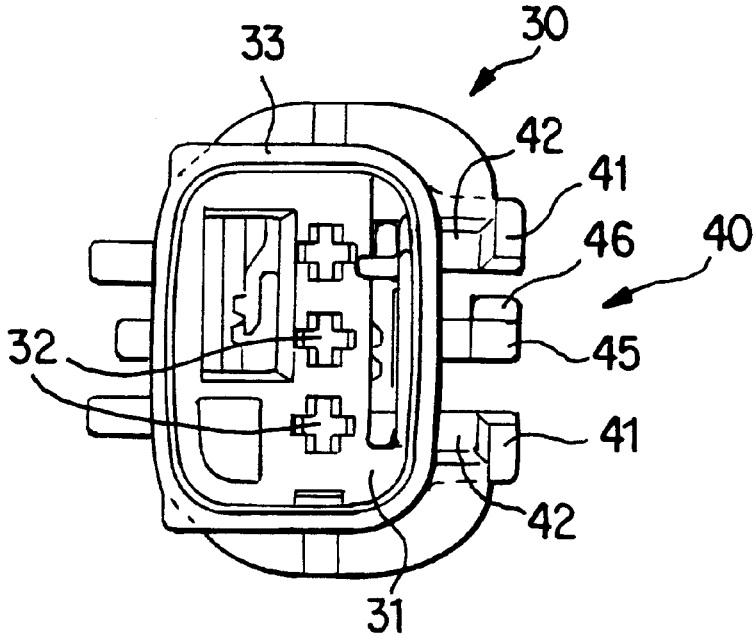
FIG. 4 is a front view of a second sub-housing.

The second sub-housing 30 is smaller than the first sub-housing 20 described above. As shown in FIG. 4, three cavities 32 are aligned vertically within a terminal housing member 31 thereof. A hood member 33 is formed on an outer circumference of an anterior face of this terminal housing member 31. Male terminal fittings are inserted into the cavities 32 from a posterior direction, and are housed therein.

A stopping configuration of the housing chambers 15 and 16 relative to the sub-housings 20 and 30 is described below.

As shown in FIG. 1, a stopping mechanism 40 is provided on a base face of a posterior end of the sub-housing 20 at a central portion thereof in a width-wise direction. As shown in FIG. 3, the stopping mechanism 40 comprises a pair of left and right guiding rails 41 which are cross-sectionally hook shaped, mutually face one another, and are separated by a prescribed distance. A protrusion 42 is formed on a posterior end of each guiding rail 41. A stopping arm 45 is formed between the two guiding rails 41. This stopping arm 45 extends from its posterior end and protrudes in an anterior direction. A protruding member 46 is formed on a side face (the right face in FIG. 1) of the stopping arm 45 at a location close to the tip thereof. An anterior face of this protruding member 46 forms a tapered face 47 which is used for guiding it.

Figure 5:
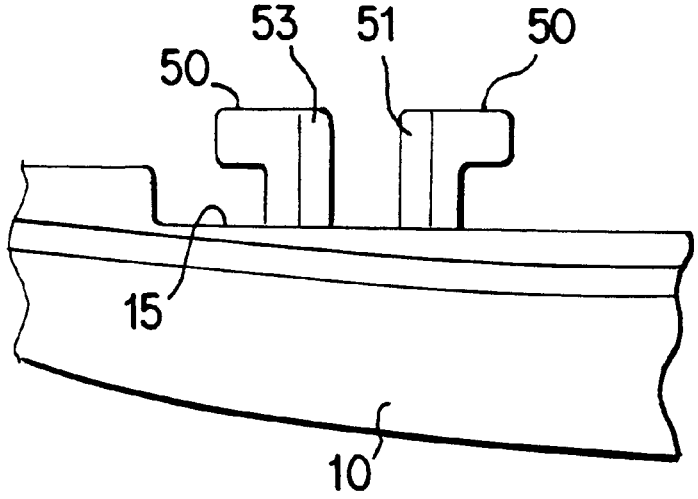
FIG. 5 is a partially expanded front view showing components of a stopping plate.

A pair of stopping plates 50 protrude upwards from a base face of a posterior end of the first housing chamber 15. As shown in FIG. 5, these stopping plates 50 are cross-sectionally hook shaped and are positioned back to back. The stopping plates 50 are capable of being inserted into the interior of the guiding rails 41. A stopping member 51 is formed on an inner face of one of the stopping plates 50 (the stopping plate 50 on the right in FIG. 1) at a location close to an anterior end thereof. This stopping member 51 is capable of engaging with the protruding member 46 of the stopping arm 45. A posterior face of the stopping member 51 forms a tapered face 52 which is used for guiding it.

An auxiliary stopping member 53 is formed symmetrically on an inner face of the other stopping plate 50 at a location close to a posterior end thereof. When the stopping plate 50 has been inserted from the anterior into the sub-housing provided with the stopping arm 45, this auxiliary stopping member 53 engages with the stopping arm 45.

A stopping mechanism 40 is provided on a posterior end of the second sub-housing 30 (on the left in FIG. 1), this being identical with the stopping mechanism 40 of the first sub-housing 20. In addition, a pair of stopping plates 50 are provided on a face of the partitioning wall 12 which faces the second housing chamber 16. These stopping plates 50 are identical with those of the first housing chamber 15.

A stopping groove 38 is formed between two flanges 37 at the posterior end of the second sub-housing 30. A resilient stopping protrusion 17 which is bent in an anterior direction into a hairpin shape is provided on a wall opposite the partitioning wall 12 of the second housing chamber 16. A protruding member 18 is provided on this resilient stopping protrusion 17.

The cover 60 is large enough to cover the first sub-housing 20 and the second sub-housing 30 from their posterior faces. The cover 60 protrudes in an anterior direction on the right side in FIG. 1 to form an approximately flat L-shape. An anterior face (towards the top in FIG. 1) and a left face thereof are open. Furthermore, a right edge portion of a posterior face thereof is removed to form a diagonal face.

Open edges at an anterior face of side plates of a long and narrow portion 61 (on the left in FIG. 1) of the cover 60 make contact with the posterior face of the first sub-housing 20. Open edges at an anterior face of side plates of a protruding portion 62 (protruding to the anterior on the right side) of the cover 60 fit with an outer side of the posterior end of the second sub-housing 30.

Locking protrusions 25 protrude from both sides of the stopping mechanism 40 located at the posterior end of the base face of the first sub-housing 20. Anterior faces of these locking protrusions 25 form tapered faces 26 which are used for guiding them. Further, another pair of locking protrusions 25 are provided symmetrically on an upper face of the first sub-housing 20.

Locking protrusions 35 arc also provided on the posterior end portion of the second sub-housing 30, one locking protrusion 35 being provided on a base face side and another locking protrusion 35 being provided on an upper face side thereof. Anterior faces of these locking protrusions 35 form tapered faces 36 which are used for guiding them.

A pair of left and right locking members 64 are formed on both sides of the plate forming the long and narrow portion 61 on the left side of the cover 60, the tips thereof protruding from the anterior sides of this long and narrow portion 61. A locking hole 65 is formed in the protruding tip of each locking member 64, the locking protrusions 25 of the first sub-housing 20 fitting therewith. Furthermore, the base face pair of locking members 64 are spaced so as to grip the two guiding rails 41 of the stopping mechanism 40 of the first sub-housing 20.

Moreover, locking holes 66 are formed on both sides of the plate forming the protruding portion 62 on the right side of the cover 60. These locking holes 66 fit with the locking protrusions 35 of the second sub-housing 30.

Figure 7:
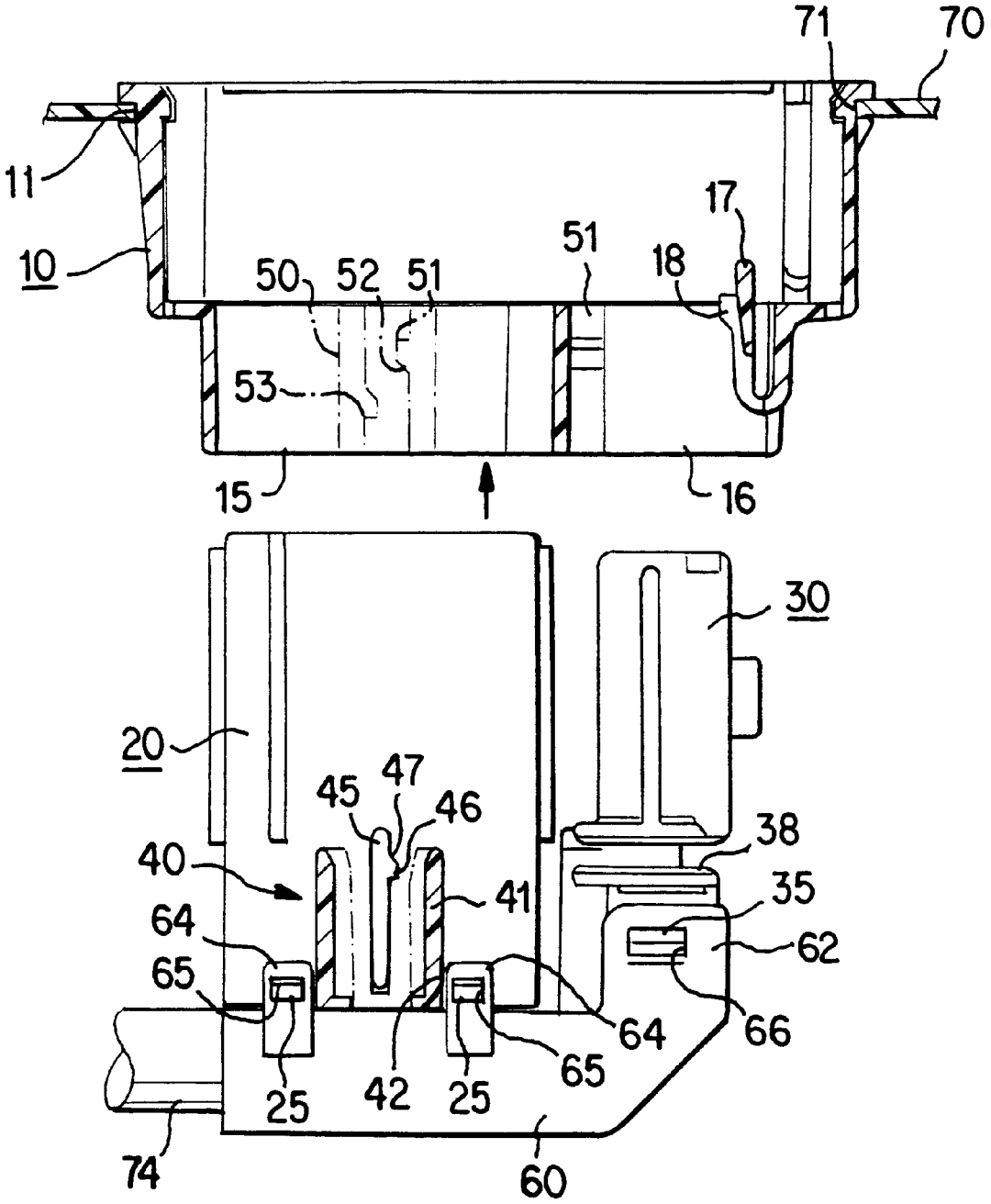
FIG. 7 is a partially cut-away base face view showing the sub-housing prior to being installed in the frame.

The present embodiment is configured as described above, and it assembly is described below. Firstly, as shown in FIG. 7, the frame 10 is attached to the attachment hole 71 of the panel 70 of the motor vehicle in the manner described above.

Figure 6:
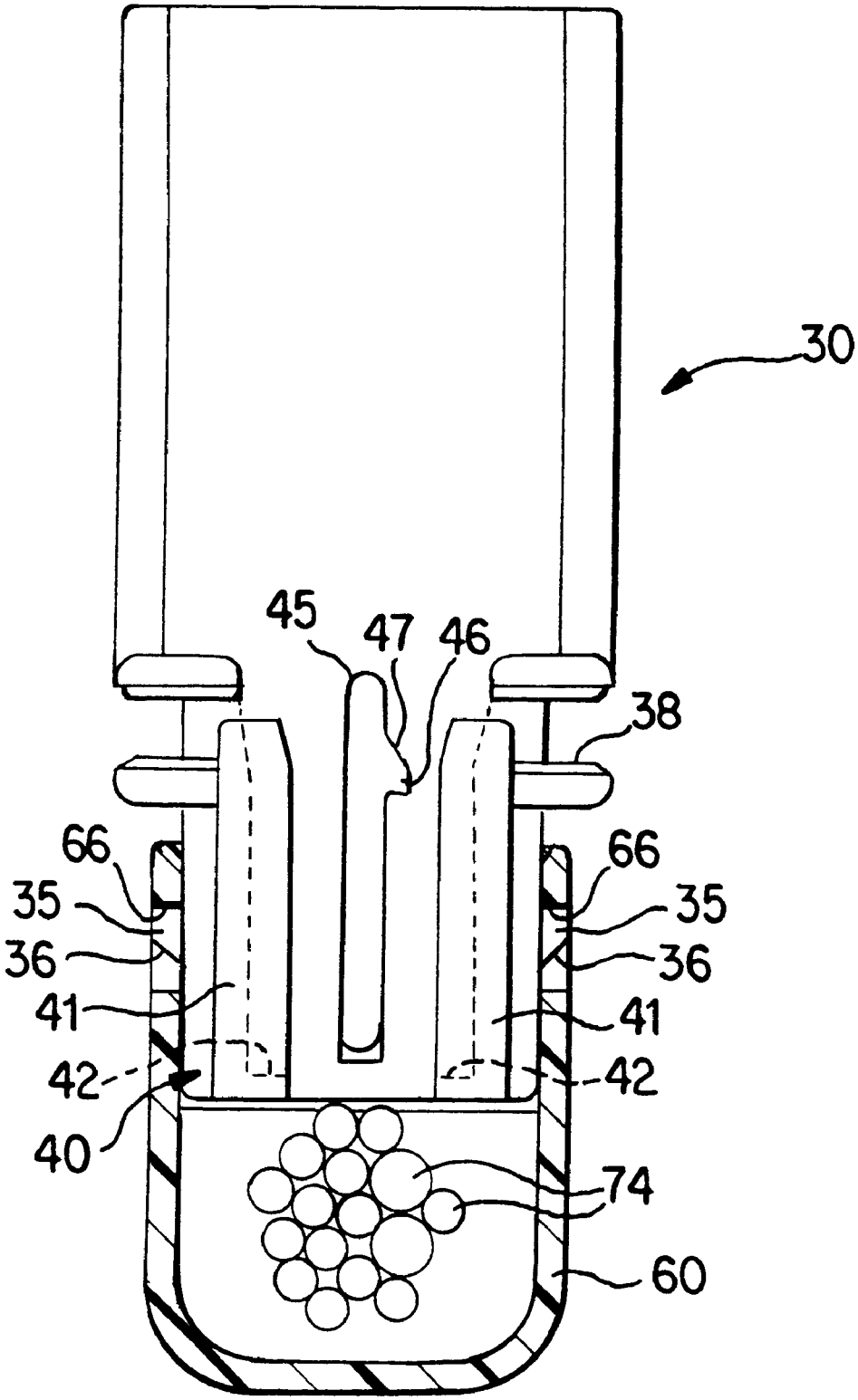
FIG. 6 is a cross-sectional view showing the portion of the second sub-housing attached to a cover.

Next, at the site where the harness is assembled, the cover 60 is attached to the two sub-housings 20 and 30. The female terminal fittings, to which the ends of electric wires 74 are fixed, are housed within the cavities 22 and 32 of the sub-housings 20 and 30. Then the posterior end of the second sub-housing 30 is inserted into the protruding portion 62 of the cover 60, as shown by the arrow X in FIG. 1. The two side plates of the protruding portion 62 rise over the tapered faces 36 of the locking protrusions 35 of the second sub-housing 30, these side plates opening resiliently and the second sub-housing 30 is pushed in up to a specified distance. Then, as shown in FIG. 6, the two side plates close and the locking protrusions 35 fit with the locking holes 66, the second sub-housing 30 thereby being attached within the right side of the cover 60. The electric wires 74 which extend from the second sub-housing 30 are bent at approximately a right angle, pass through the cover 60 and extend out from an opening on the left side thereof (as viewed).

Next, as shown by the arrow Y in FIG. 1, the posterior end of the first sub-housing 20 is attached to the long and narrow portion 61 at the left side of the cover 60. At this juncture, the left and right locking members 64 grip the two guiding rails 41 of the stopping mechanism 40 as these two guiding rails 41 are pushed in. While this pushing-in is occurring, the locking members 64 rise over the tapered faces 26 of the locking protrusions 25 and move outwards. The first sub-housing 20 is pushed in until the posterior face thereof makes contact with the anterior edges of the side plates of the cover 60. Thereupon, the locking members 64 return resiliently to their original shape, and the locking protrusions 25 fit within the locking holes 65. In this manner, as shown in FIG. 7, the first sub-housing 20 is attached within the left side of the cover 60. The electric wires 74 which extend from the first sub-housing 20 are bent at approximately a right angle, pass through the cover 60 and extend out from an opening on the left side thereof (as viewed).

The two sub-housings 20 and 30 and the cover 60 are attached at the harness assembly site in the manner described above. Then, in this state, they are transported to the site where they are attached to the motor vehicle.

At the site where they are attached to the motor vehicle, the two sub-housings 20 and 30, which have been unified by being attached to the cover 60, are inserted from the posterior (shown by the arrow in FIG. 7) into the corresponding housing chambers 15 and 16 of the frame 10.

When the posterior end portion of the first sub-housing 20 approaches the posterior edge of the frame 10, the stopping plates 50 of the frame 10 approach the tips of the guiding rails 41 of the stopping mechanism 40. Then the stopping plates 50 are inserted between the two guiding rails 41 and the first sub-housing 20 is pushed in.

Figure 8:
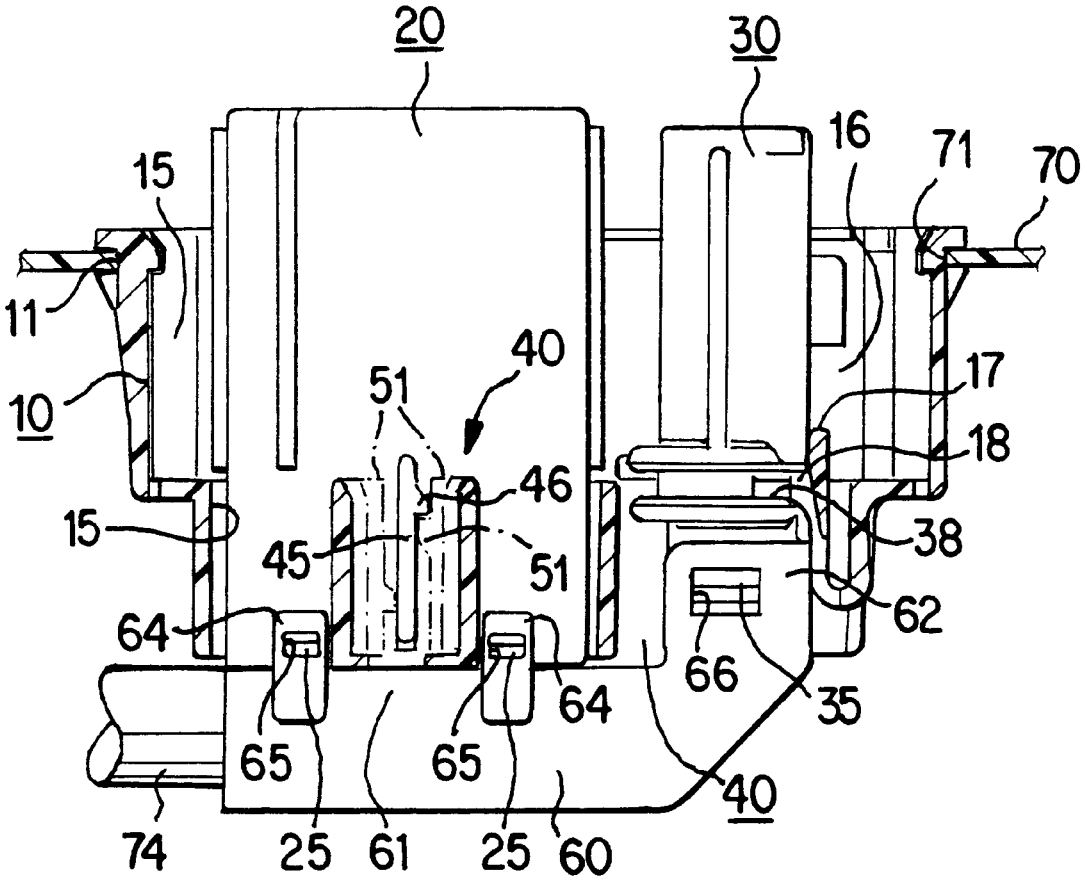
FIG. 8 is a partially cut-away base face view showing the sub-housings in an installed state in the frame.

While this pushing-in is occurring, the protruding member 46 of the stopping arm 45 engages with the stopping member 51, the tapered faces 47 and 52 mutually guide one another and, as the first sub-housing 20 is pushed in, the stopping arm 45 bends to the left (with respect of FIG. 7) using the auxiliary stopping member 53 as the centre. The protrusions 42 of the guiding rails 41 make contact with the stopping plates 50 and the pushing-in is halted. As shown in FIG. 8, the stopping arm 45 returns to its original straight state and the stopping member 51 is retained behind the posterior face of the protruding member 46.

In the case of the second sub-housing 30, the stopping mechanism 40 engages with the stopping plates 50 in the same manner, and the protruding member 18 of the resilient stopping protrusion 17 fits into the stopping groove 38 of the second sub-housing 30. By the means described above, the two sub-housings 20 and 30 are housed within the corresponding housing chambers 15 and 16 in a state whereby they cannot move in an anterior or posterior direction. In addition, the cover 60 is attached to the posterior faces of the sub-housings 20 and 30.

According to the embodiment described above, the cover 60 and the two sub-housings 20 and 30 can be attached in advance. Consequently, when the frame 10 is fixed to a motor vehicle or the like, the two sub-housings 20 and 30 are transported with the cover 60 being in an attached state therewith and these sub-housings 20 and 30 need merely to be inserted and engaged with the frame 10. As a result, transportation to the motor vehicle assembly site is easier and, as assembly can be completed by inserting the pre-assembled sub-housings 20 and 30 into the frame 10, the assembly operation at the site is simplified.

The present invention is not limited to the embodiments described above with the aid of figures. For example, the possibilities described below also lie within the technical range of the present invention. In addition, the present invention may be embodied in various other ways without deviating from the scope thereof.

(1) In contrast to the above embodiment, the male sub-housing may equally well be housed within the frame.

(2) Three or more sub-housings may be housed within the frame.

(3) The resilient stopping protrusion 17 may alternatively be provided on a partition wall between the chambers 15, 16.

What is claimed is:

1. An electrical split connector comprising a frame to be fixed in a panel and defining a plurality of chambers, said frame comprising a first end having a panel engaging portion and a second end opposite said first end, a first of said frame chambers including a pair of spaced stopping members extending between said first and second ends of said frame, a second of said frame chambers including a resilient member extending from an inner wall of said second chamber, a plurality of sub-connectors having wires protruding therefrom, each of the sub-connectors being inserted into a respective one of said chambers of said frame through said second end for securely engaging said frame, a first of said sub-connectors including a stopping arm being received between said stopping members of said first chamber and at least one of said stopping members securely engaging said stopping arm of said first sub-connector when said first sub-connector is positioned within said frame, a second of said sub-connectors including a stopping groove for engaging said resilient member of said second chamber and retaining said second sub-connector against movement within said second chamber when positioned within said frame, and a cover to enclose and guide the wires of said sub-connectors in a predetermined direction, wherein said sub-connectors and cover are each provided with co-operating latch members that interconnect to form an integral sub-assembly that is separable from the frame and inserted as a discrete unit into said frame and wherein said cover is free of a direct connection with said frame.

2. A connector according to claim 1 wherein said latch members comprise protrusions of said sub-connectors and co-operating openings of said cover.

3. A connector according to claim 2 wherein a plurality of said openings are provided in resilient projections of said cover.

4. A connector according to claim 3 wherein said projections extend in the direction of fitting of said cover to said sub-connectors.

5. A connector according to claim 4 wherein said projections laterally engage guide surfaces of one of said sub-connectors.

6. A connector according to claim 5 wherein a pair of said projections is provided, said pair of projections engaging either side of a corresponding guide member having guide surfaces at opposite sides thereof.

7. A connector according to claim 1 wherein the frame further includes a gripping structure for fixing the frame in an opening in the panel.

8. An electrical split connector of claim 1 wherein said first sub-connector includes spaced guide rails; said stopping arm is positioned intermediate said guide rails; and said stopping members of said first chamber are received between said guide rails when said first sub-connector is positioned within said frame.

9. A method of inserting a plurality of sub-connectors into a panel comprising the steps of:

fixing a first end of a frame in an aperture of the panel;

latching a plurality of sub-connectors directly to a cover to form an integral sub-assembly, the cover enclosing and guiding wires protruding from respective sub-connectors;

inserting said sub-assembly into said frame, said inserting step including advancing the sub-connectors into said frame through a second end of said frame, said second end being opposite said first end; and securely engaging said frame directly with said sub-connectors so that said sub-connectors are retained against movement relative to said frame, said securely engaging step including positioning a stopping arm of a first of said sub-connectors between a pair of spaced stopping members of a first of a plurality of frame chambers, securely engaging said stopping arm of said first sub-connector with at least one of said stopping members when said first sub-connector is positioned within said frame, and engaging a stopping groove of a second of said sub-connectors with a resilient member extending from a wall of said second chamber for retaining said second sub-connector against movement within said second chamber.

10. The method according to claim 9 wherein the step of securely engaging the frame directly with the sub-connectors includes maintaining the cover free of a direct connection to said frame.

* * * * *